US005301629A

United States Patent [19]

Kleyh et al.

[11] Patent Number: 5,301,629

[45] Date of Patent: Apr. 12, 1994

[54] SEGMENTED BOAT

[76] Inventors: Norman F. Kleyh; Kathleen C. Kleyh, both of 155 E. Kellogg Rd., Bellingham, Wash. 98226

[21] Appl. No.: 950,951

[22] Filed: Sep. 25, 1992

[51] Int. Cl.[5] ..... B63B 7/04

[52] U.S. Cl. ..... 114/352

[58] Field of Search ..... 114/352, 353, 77 R

[56] References Cited

U.S. PATENT DOCUMENTS

| | | | |
|---|---|---|---|
| 2,880,429 | 4/1959 | Henry | 114/353 X |
| 3,768,107 | 10/1973 | Donoughe | 114/352 |
| 3,996,635 | 12/1976 | Wilkes et al. | 114/352 |
| 4,522,145 | 6/1985 | Stone | 114/352 |
| 4,790,256 | 12/1988 | Levine | 114/352 |

FOREIGN PATENT DOCUMENTS

| | | | |
|---|---|---|---|
| 850253 | 10/1960 | United Kingdom | 114/352 |

OTHER PUBLICATIONS

"J. P. Downs Memorial Bifurcating Dinghy", *Rudder Magazine*, Jan. 1977.

*Primary Examiner*—Sherman Basinger

*Attorney, Agent, or Firm*—Hughes & Multer

[57] ABSTRACT

A rigid hull boat made up of detachable bow and stern sections. These are joined at abutting transverse bulkheads: male locking lugs project from the bulkhead of the bow section, and these are received in corresponding recesses in the bulkhead of the stern section. The upper edges of the bulkheads are held together by a channel member through which bolts are passed. The interlocking elements eliminate side-to-side movement between the two bulkheads, and also prevent them from spreading apart at the bottom. There are also bevels around the edges of the two sections which guide the locking members into engagement. The bow section nests within the stern section for storage. If desired, the two sections can be used as independent craft, and in some embodiments, the bow section may be inverted and mounted atop the stern section to provide an enclosed cartop carrier.

13 Claims, 4 Drawing Sheets

SEGMENTED BOAT

FIELD OF THE INVENTION

The present invention relates to watercraft in general, and, more particularly, to a boat or dinghy which can be disassembled into two or more sections for storage.

BACKGROUND OF THE INVENTION

Many boats, dinghies, or other small craft are only used on an occasional basis. When it is not being used, the size of the craft presents a storage problem, and this also often makes it difficult to transport. For example, most large pleasure boats carry a dinghy for use as a tender, and this occupies a large amount of valuable deck space or other room while it is stowed onboard. Even if it is stored in a land-bound garage or shed, the owner usually wishes that it took up less space. A similar problem occurs when the boat is transported over the road. Even a relatively small craft may present serious handling problems when it becomes necessary to lift this onto the vehicle, and it is almost always necessary to provide some special arrangement—a roof rack or trailer, for example—to carry the boat, and this uses up space which could otherwise be used to carry baggage or equipment.

Attempts to overcome these problems have taken various forms, usually with limited success. For example, some have turned to inflatable boats, but these often lack real durability, and require so much time and effort to inflate and assemble that many are simply left permanently inflated; furthermore, the hull forms of most inflatables are totally unsuited for rowing or sailing, which limits their utility for many applications. Similarly, collapsible boats also lack durability and are difficult to set up, and furthermore are frequently deficient in seaworthiness. In short, these approaches require compromises in the hull structure which are so great that the end result varies widely from the ideal form and character for a small boat.

Another approach which has been proposed involves providing a boat with a rigid (i.e., non-collapsible) hull of generally conventional form, and making this in two sections so that it can be broken down for storage or transport. An article entitled "J. P. Downs Memorial Bifurcating Dinghy" in the January 1977 issue of Rudder Magazine shows plans for a boat which illustrates this. The boat is constructed of plywood, and there are bow and stern sections. The bow section is provided with a flat rear bulkhead and the stern section is provided with a flat forward bulkhead, and these are butted up against one another and secured together to assemble the boat. The two sections can be taken apart, and the bow section nests within the stern section for stowage. The disassembled halves will also float, and can be used independently as small craft.

While this approach is superior to inflatable or collapsible craft in many respects, particularly from the standpoint of providing a seaworthy and durable hull which is of a satisfactory form for rowing or sailing, these previous attempts have exhibited serious deficiencies. Perhaps the most significant of these has been the weakness of the connection between the two hull halves. For example, in the "J. P. Downs" design noted above, the connection is made by hinges and pins across the top of the joined bulkheads, and latches on the bottom of the hull. Alternatively, there is a simple bolt-joint system. Simply put, the interconnection which is provided by either of these arrangements is inadequate to prevent the hull sections from working back and forth relative to one another when the boat is in a seaway. At the least, this is a constant annoyance when rowing or sailing the boat, and at worst it presents a serious wear problem and the potential for eventual failure with catastrophic consequences. These deficiencies have been serious enough to prevent the concept of a two-piece rigid hull from reaching its full potential.

Accordingly, there is a need for a rigid hulled boat having two-piece construction such that the boat can be broken down for storage or handling, yet which is provided with a structure for joining the two halves so that these cannot work back and forth relative to one another. Furthermore, there is a need for a boat having such a structure which is sufficiently durable to provide the boat with an extended working life, and to obviate safety hazards which would precipitate from wear of the joint between the two halves. Still further, there is a need for a boat having such a joint which can be constructed of fiberglass or other resinous materials which are commonly employed in modern boat construction.

SUMMARY OF THE INVENTION

The present invention has solved the problems cited above, and broadly, this is a boat comprising a first section having a first transverse bulkhead at an end thereof, a second section having a second transverse bulkhead at an end thereof, engagement means operative in response to movement of the bulkheads together in face-to-face abutment for holding the first and second sections together in a fixed relationship, and locking means for selectively maintaining the bulkheads in face-to-face abutment so as to prevent disengagement of the engagement means.

The engagement means may comprise at least one lug member formed on and extending from the first bulkhead, and a recess member formed in and extending into the second bulkhead for receiving the lug member so as the bulkheads are moved together into face-to-face abutment along a substantially common plane.

The engagement means may further comprise means for preventing separation of these members by the bulkheads pulling apart in a direction generally perpendicular to the common plane; this may comprise a flange portion formed on and extending downwardly and outwardly from a lower edge of the lug member, and a socket portion formed on and extending downwardly and inwardly from a lower edge of the recess member so that an upwardly extending lip is formed at an outer edge thereof, the socket portion being configured to receive the flange portion so that the flange portion fits behind this lip and is retained in the socket thereby. The locking means for this may comprise means for selectively restraining the first bulkhead against upward movement relative to the second bulkhead, so as to prevent separation of the lug member from the recess member by the flange portion lifting over the lip of the socket portion.

The engagement means may further comprise means for holding the bulkheads together against side-to-side movement in the common plane. This may comprise edge portions of the lug member on the first bulkhead and the recess member in the second bulkhead, these edge portions extending substantially perpendicular to the common plane and being configured to abut one another so as to resist lateral movement between the bulkheads and shear.

The lower ends of the lug member and the recess member may be positioned proximate lower edges of the bulkheads so as to prevent these from spreading apart. The engagement means may therefore further comprise means for preventing the upper edges of the bulkheads from spreading apart; this may comprise a channel member which is configured to fit over the upper edges of the bulkheads when these are in face-to-face abutment, the channel member having depending flange portions for fitting against outer surfaces of the bulkheads so as to hold the bulkheads in abutment with one another. This may be secured by retaining bolts which pass through cooperating bores in the flange portions of the channel member and the upper edges of the bulkheads, and these also serve to restrain the first bulkhead against upward movement relative to the second bulkhead.

The first section of the boat may be a bow section, and the second section may be the stern section. The bow section may be sized to fit within the stern section so as to permit these to be nested for storage. Also, the bow section may be configured to be placed atop the stern section in an inverted position so as to form an enclosed storage container. In this case, each of the sections may have upstanding wall portions which define gunwale edges, the gunwale edges of the bow section being matched to the gunwale edges of the stern section in the inverted position so as to form a seal therewith. Clamp means may be provided for securing the bow section to the stern section in this inverted position, and means may be provided for mounting the container which is thus formed atop a vehicle as a cartop carrier.

DETAILED DESCRIPTION

Figure 1:
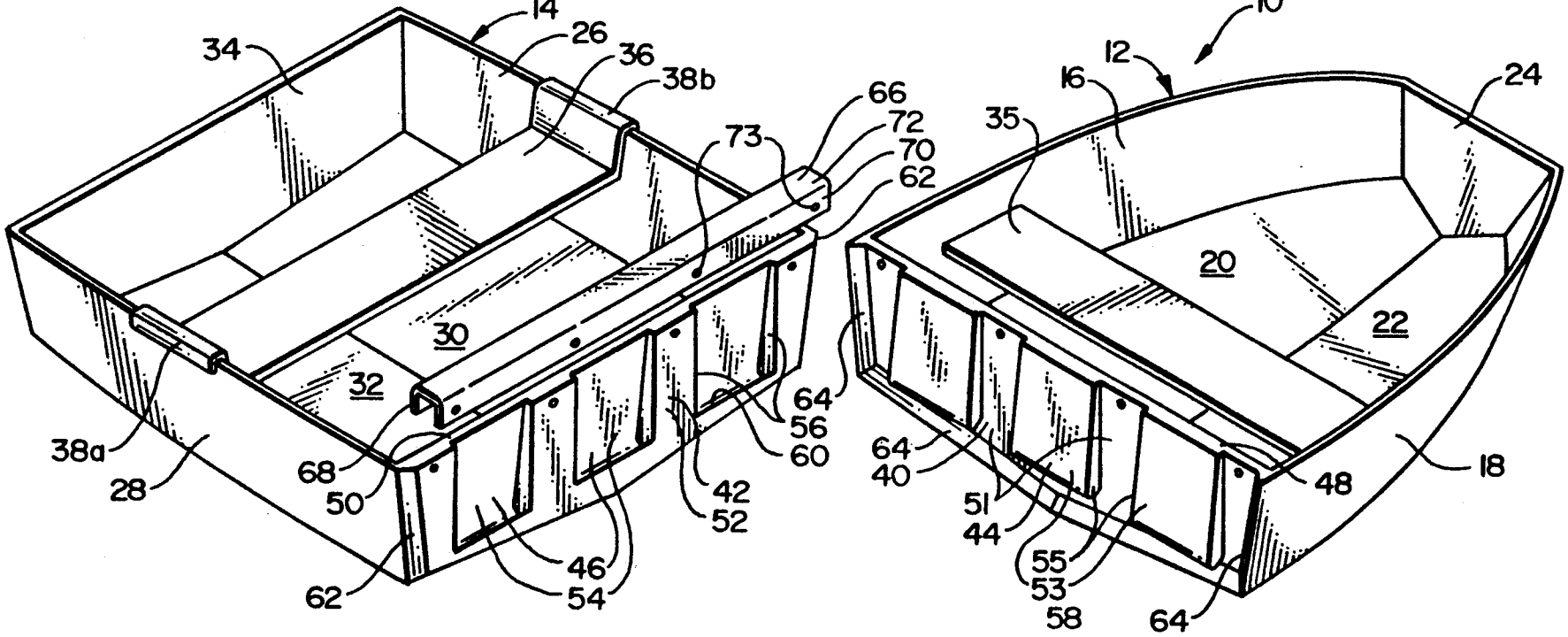
FIG. 1 is a perspective view of a boat which incorporates the present invention, the two halves being shown separated to illustrate the interlocking members which join these.

FIG. 1 shows a rigid-hulled boat in accordance with the present invention. As can be seen, this is divided into a bow section 12 and a stern section 14. The exemplary boat which is shown in FIG. 1 has the hull form of a conventional pram, but it will be understood that the present invention may be incorporated in virtually any hull form which may be desired. Furthermore, the boat may be constructed in more than two sections if desired. The sections are preferably constructed of fiberglass, ABS plastic, metal, wood, or other material having suitable characteristics for marine construction.

The bow section 12 is provided with upwardly extending side members 16, 18, floor members 20, 22, and a stem section 24, these being generally of a conventional configuration. Similarly, the stern section 14 is provided with generally conventional side members 26, 28, floor members 30, 32, and a transom section 34. These external members provide the boat 10 with its generally conventional rigid hull form. A seat 35 is mounted across the side members 16, 18 of the bow section in a generally conventional fashion, and a second seat 36 is mounted across the gunwales of the stern section; however, the latter seat 36, rather than being of conventional configuration, is provided with upstanding, hook-shaped hanger portions 38*a*, 38*b* at its ends which fit over the gunwales at the upper edges of sides 26, 28; the seat can therefore be removed by simply lifting this out, for reasons which will become apparent from the following description.

The aft end of bow section 12 is closed by a watertight transverse bulkhead 40, and similarly, the forward end of the stern section 14 is closed by another watertight transverse bulkhead 42. The outer faces of bulkheads 40 and 42 are provided with interlocking features which engage one another when these are moved into abutment, these being divided into two principal groups.

The first group of interlocking features comprises a series of male lugs 44 which extend from the forward bulkhead 40, and a corresponding series of female recesses 46 formed in the aft bulkhead 42. These features preferably extend all the way to the upper edges 48, 50 of the bulkheads, and are separated by a series of flats 51, 52, so that the upper edges of the two bulkheads form a complementary, interlocking "zigzag" pattern. There are three of the male lugs 44 in the embodiment which is illustrated, and each of these is provided with a generally rectangular, planar outer face 53. This slopes outwardly (i.e., toward the stern section) toward the lower end of the lug, and there is a correspondingly sloped rectangular face 54 in each of the recesses. The lateral edges of the lugs, in turn, are formed by side faces 55 which extend generally parallel to the lengthwise axis of the boat, and the recesses 46 are similarly bordered by corresponding side faces 56.

The lower ends of the locking lugs and recesses extend into the lower portions of the bulkheads 40, 42, and preferably extend to at least the bottom one-third thereof. At the bottom ends of the lugs 44 there are outwardly and downwardly protruding ridges or flange portions 58, and corresponding inwardly and downwardly extending socket portions 60 are formed at the lower ends of the recesses 46; as will be discussed in greater detail below, the flanges are received in these sockets when the two sections are mated, and are retained therein by the lips at the outer edges of the sockets.

Accordingly, it will be understood that the interlocking abutment of the side faces of the lugs and recesses which extend over much of the height of the hull serves to effectively resist shear forces in a transverse direction, thus preventing lateral movement along the joint between the two sections of the hull. The locking interfit of the knuckles and sockets at the lower ends of these features serves in turn to prevent the lower portions of the bulkheads from spreading apart, as when the hull sags under a load or in a seaway.

The second interlocking feature of the two bulkheads comprises a chamfer or bevel 62 along the sides and across the bottom of the aft bulkhead 42, and a corresponding inlet bevel 64 on both sides and across the bottom of the forward bulkhead 40. The bevelled edges consequently extend around three sides of the adjoining bulkheads 40, 42, and so these serve a self-centering function as the two parts are brought together, helping to bring the other features into mating alignment. Then, as the lugs are pressed home into locking engagement with the recesses, the two bevelled surfaces 62 and 64 are forced into firm abutment with one another, so that these provide additional resistance to transverse and vertical forces, and impart rigidity to the overall structure.

Figure 2:
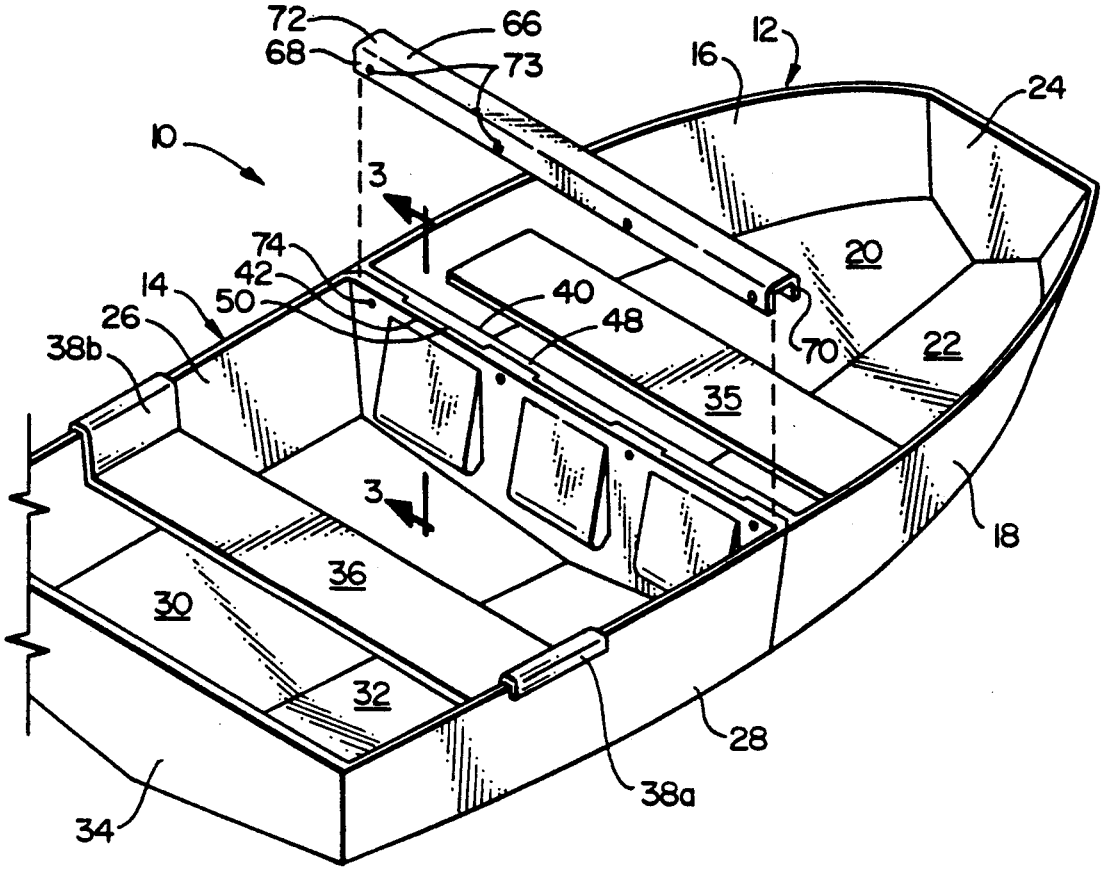
FIG. 2 is a perspective view of the boat of FIG. 1, this showing the two halves having been assembled together, and the installation of the channel member which locks these together.

Once the bow and stern sections 12 and 14 have been fitted together in this manner, so that the flats of the bulkheads 40 and 42 firmly abut one another and their features are in locking engagement as is shown in FIG. 2, the locking channel 66 is fitted over the top of the two bulkheads. As can be seen, this has depending flanges 68, 70 which fit closely against the outer surfaces of the two bulkheads 40, 42 as the channel member is slipped down over their upper edges. When the web 72 of the channel member comes into abutment with the upper edges of the bulkheads, a series of holes 73 are brought into alignment with corresponding bores 74 which extend continuously through the upper edges of the two bulkheads, and bolts are then passed through the holes and cooperating bores. The locking channel and bolts therefore hold the upper edges of the two bulkheads together and prevent these from spreading apart. The locking channel is preferably fabricated of a corrosion-resistant metal, such as stainless steel or anodized aluminum.

Assembled as shown in FIG. 2, the exterior of the boat presents a smooth, continuous hull form which exhibits good maneuverability and is well adapted to rowing or sailing, as well as to being propelled by an outboard motor. It is also a highly rigid structure which is both durable and seaworthy. The engaged features of the two hull portions are all relatively large sized members with large planar engagement surfaces, and so these are much less susceptible to wear than the hinge and latch or simple bolt-through arrangements described above.

Figure 3:
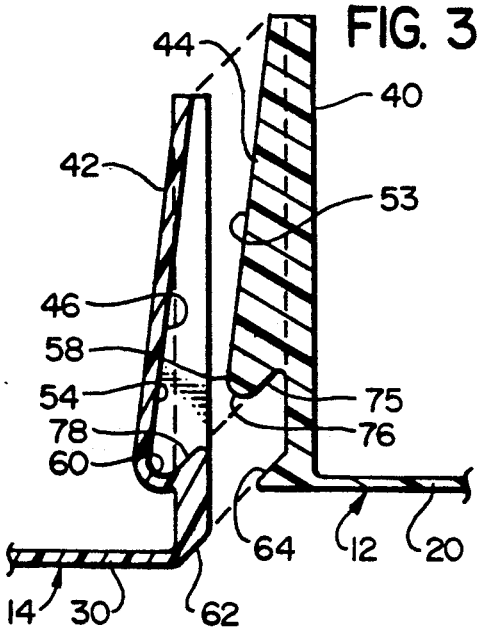
FIG. 3 is a cross-sectional view taken through the adjoining bulkheads of the forward and aft sections of the boat of FIGS. 1-2, showing the manner in which the interlocking portions of the two sections line up with one another.
Figure 4:
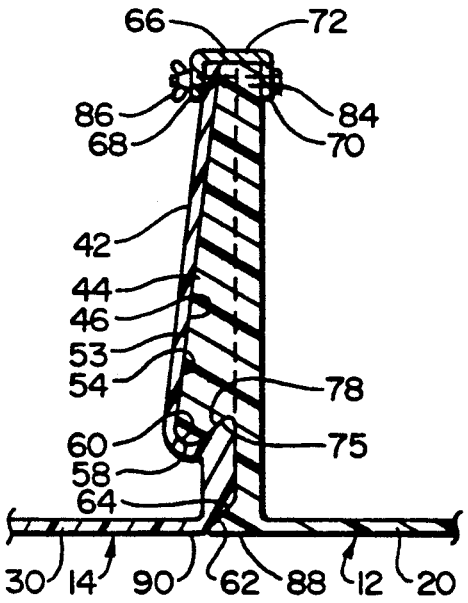
FIG. 4 is a cross sectional view similar to FIG. 3, showing the two halves having been joined and the locking channel having been fitted over the top of the abutting bulkheads to hold these together.

FIGS. 3 and 4 provide a more detailed view of the interlocking features of the two hull halves, and how these fit together in mating relationship. FIG. 3 shows the components having been brought into alignment with one another, but before actual engagement. It can therefore been seen that the sloped mating surfaces on (a) the flanges 58 and the sockets 60, and (b) the outer bevel 62 and inlet bevel 64, all extend in generally parallel planes, as indicated by the several dotted lines. Therefore, to mate the two sections together, the bow section is moved rearward and downwardly relative to the stern section in the direction of these parallel planes.

As was noted above, the lugs 44 depend from the transverse surface of bulkhead 40; these have sloped outer and inner surfaces 53 and 75 which extend downwardly from the bulkhead, and which are joined at the outer edges 76 of flange portions 58 by curved surfaces so as to make these easier to guide into the mouths of the sockets 60. The sockets themselves, in turn, are provided with corresponding walls 54, 78 and curved lower ends, so that these fit closely around the flange portions 58.

As a result, when the two sections are moved into engagement so that the lug 44 enters the recess 46, as is shown in FIG. 4, the abutment of the inner face 75 on the flange member with the inside face 78 of the socket prevents these from being drawn apart in a longitudinal direction; in other words, the flange fits behind the outer lip of the socket and is retained by this against forces tending to spread the bulkheads apart at this point. Any movement in an upward direction, in turn, is prevented by the locking channel 66, this preferably being held in place by bolts 84 and conveniently installed wing nuts 86, with additional resistance to upward loads in the being provided by the abutting surfaces of the interlocking features. Accordingly, the assembly is securely locked together in a very rigid relationship.

FIG. 4 also shows that, by arranging the inlet bevel on the forward bulkhead 40 so that this and the bevel 62 slope downwardly toward the aft end of the boat, a relatively streamlined joint is formed where the rear rim 88 of the bow section meets the outer surface 90 of the stern section; in other words, the bevel is angled with the flow, instead of being angled into it in the manner of a scoop. Another important advantage of this arrangement is that the male locking lugs project from the bulkhead of the bow section, and so will be protected when this is nested within the stern section, as will be described below.

Figure 5:
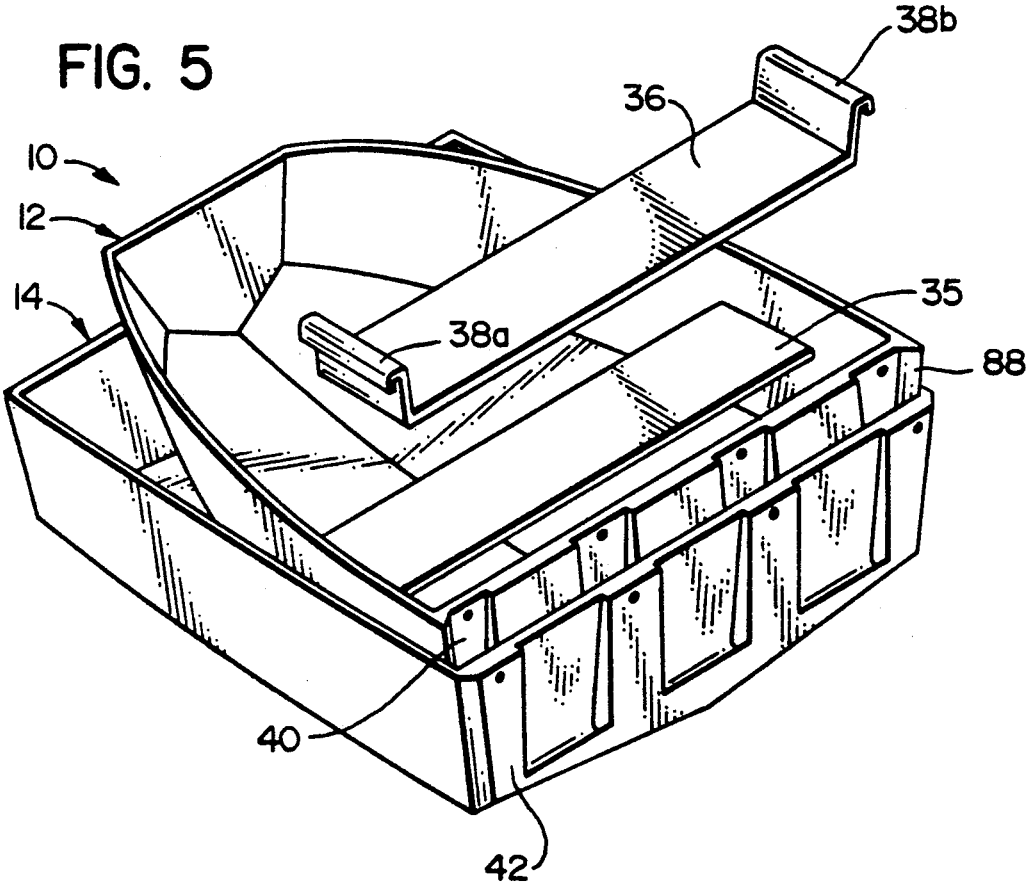
FIG. 5 is a perspective view of the boat of FIGS. 1-4, showing the bow and stern sections having been detached from one another, and the bow section being nested within the stern section for storage.

FIG. 5 shows the manner in which the sections of the boat 10 are nested within one another after this has been broken down. To do this, the locking channel is removed, and the bow section is pulled upwardly and forwardly away from the stern section so as to disengage the locking lugs. The rear seat 36 is removed upwardly from the stern section so that its hanger portions **38*a*, 38*b* are freed from the gunwales, and is lifted away. The interior of the stern section 14 thus having been cleared of obstructions, the bow section is reversed and set within this; being that in many hull configurations the bow of the boat is somewhat tapered, and the stern section tends to be beamier and more able to accommodate the bow section within its interior, it is preferable for many embodiments to size the bow section somewhat shorter than the stern section so that it will fit within the latter. Preferably, the floor members of the two sections are configured to fit relatively flat against one another, and the side members are sized so that these are fairly closely matched when the sections are nested, thus providing a compact and neat package. Also, as was noted above, because the projecting flange portions of the male locking lugs are on the bow section, these are protected inside the stern section when the two parts are nested, thus eliminating the possibility that these might be damaged or knocked off in rough handling. Also, the projecting rim 88 around the edge of the bow section rides against the outer surface of bulkhead 42 and so prevents the lugs from being banged into the upper edge of the bulkhead as the bow section is being lowered into the stern section. Finally, seat 36** is set within the interior of the bow section for storage.

Figure 6:
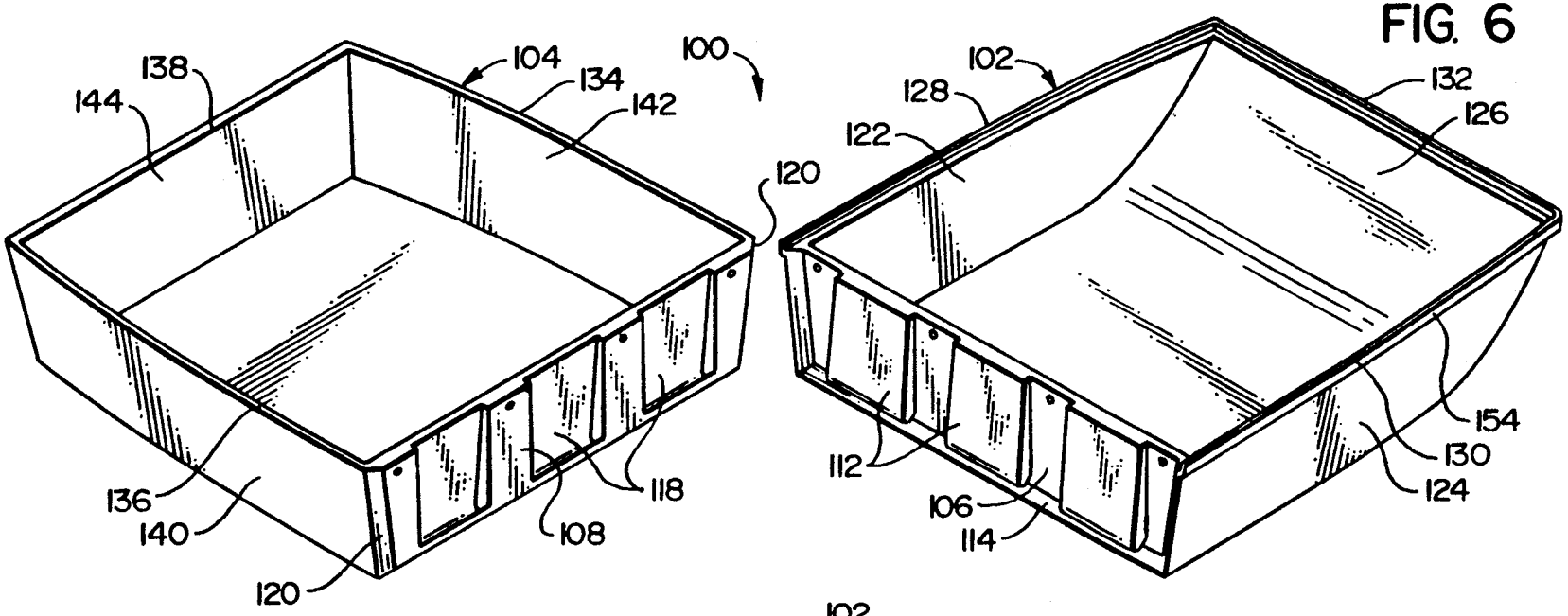
FIG. 6 is a perspective view of a boat in accordance with a second embodiment of the present invention, this being configured so that the bow section can be inverted and attached clamshell fashion to the top of the stern section to provide a luggage carrier.

FIG. 6 illustrates a second boat 100 which incorporates the present invention. In this embodiment, the boat, once disassembled, can be reassembled clamshell fashion to provide a cartop carrier for baggage. Accordingly, the boat 100 comprises a bow section 102 and a stern section 104; for purposes of illustration, these are shown somewhat simplified in FIG. 6 (for example, they are shown without seating). As before, the bow section 102 is provided with a transverse bulkhead 106 at its aft end, and the stern section is provided with a corresponding transverse bulkhead 108 at its forward end. The forward bulkhead is provided with locking lugs 112 and an inwardly sloped bevel 114, and the adjoining bulkhead 108 is provided with female locking recesses 118 and an outwardly sloped bevel 120; these locking features are substantially identical to those described above, and so will not be described again here.

The sides 122, 124 and the relatively flat bow panel 126 of the bow section 102 are preferably sloped inwardly toward the bottom of the bow section so that this can be nested within the stern section if so desired. However, the gunwales 128, 130, and 132 of the bow section are configured to match the gunwales 134, 136, and 138 at the tops of the sides 140, 142 and transom 144 of the stern section, when the bow section is inverted and set on top of this in the manner of a clamshell.

Figure 7:
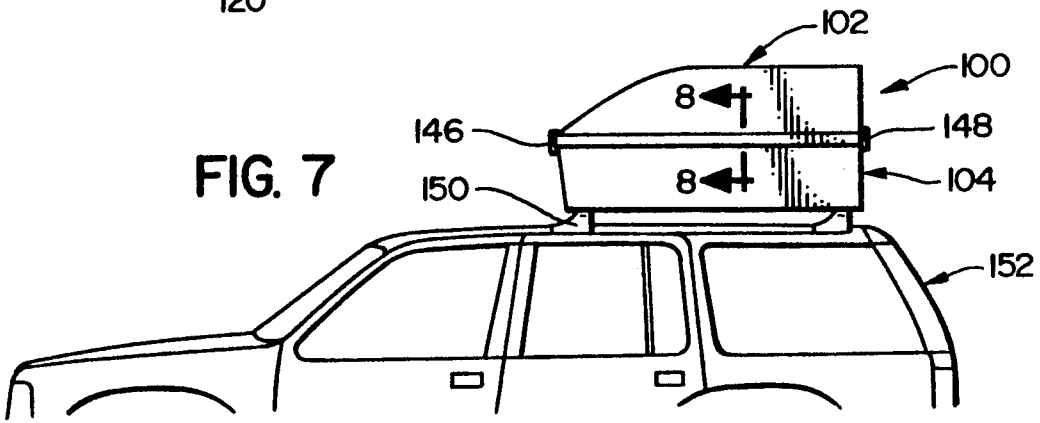
FIG. 7 is an elevational view of the boat of FIG. 6, showing the two halves having been assembled to provide the luggage carrier, this being installed on the roof rack of a vehicle.

Thus mated and secured together by clamps 146 and 148 as shown in FIG. 7, the sections of the boat provide a commodious and convenient cartop carrier for baggage. The carrier may be secured to the luggage rack 150 of a vehicle 152 by straps which engage mounting loops (not shown) on the bottom of the stern section, or by any other suitable means. Arranged in this manner, the sloped and tapered bow of the boat forms an aerodynamically efficient leading end for the carrier; if desired, the transom of the stern section may also be configured for efficient airflow.

Figure 8:
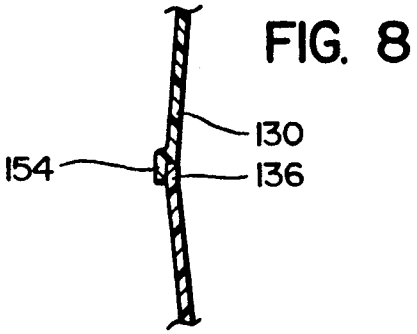
FIG. 8 is a detailed view of a cross section taken through the assembled cartop carrier of FIG. 7, taken along line 8—8, this showing the manner in which the gunwale lip of the bow section interfits with the gunwale edge of the stern section to provide a weather seal for the carrier.

Preferably, a weather seal is provided to protect the baggage within the carrier. As is shown in FIGS. 6 and 8, this may be provided by an outwardly flared lip 154 formed or mounted along the gunwales 128, 130, and 132 of the bow section. This is configured so that when the bow section is set atop the stern section so that the ridges of the gunwales abut one another in supporting relationship, as is shown in FIG. 8, the lip 154 fits over the outside of the lower gunwale so as to form a downwardly extending flap which will exclude water from the interior of the carrier. Of course, this seal may be augmented by an elastomeric strip or other sealing elements, if desired.

It is to be understood that all matter herein set forth or shown in the accompanying drawings is to be interpreted as illustrative and not in a limiting sense. It will be understood that certain features and subcombinations are of utility and may be employed without reference to other features and subcombinations. This is contemplated by and is within the scope of the appended claims.

What is claimed is:

1. A segmented boat, comprising:

at least first and second sections, each said section having a transversely extending bulkhead at an end thereof; and engagement means for selectively locking said transversely extending bulkheads together in face-to-face abutment along a substantially common plane so as to assemble said boat, said engagement means comprising:

(a) a plurality of vertically elongate lugs formed on a first said bulkhead and extending substantially the full height thereof, each said lug having:

(i) an outer face which slopes downwardly and outwardly at an inclined angle relative to said common plane, and (ii) first and second vertically extending edge faces which border said outer face and extend at a generally perpendicular angle to said common plane, a lower edge of each said lug being undercut so that a downwardly and outwardly extending flange portion is formed thereon, and said plurality of lugs being separated laterally by at least one flat area on said bulkhead which extends generally in the direction of said common plane; and (b) a plurality of vertically elongate recesses formed in a second said bulkhead and extending substantially the full height thereof for receiving said lugs on said first bulkhead, each said recess having:

(i) an inner face which slopes downwardly and inwardly at said inclined angle relative to said common plane, and (ii) first and second vertically extending edge faces which border said inner face and extend at a generally perpendicular angle to said common plane, a lower end of said recess having an upwardly extending lip so that a downwardly and inwardly extending socket portion is formed therein for receiving a said flange portion of a said lug, and said plurality of recesses being separated laterally by at least one flat area on said bulkhead which extends generally in said direction of said common plane;

whereby said first and second sections of said boat may be joined by moving said first bulkhead toward said second bulkhead and downwardly until said flat areas on said first and second bulkheads come into abutment generally along said common plane, so that said flange portions on said lugs enter into said socket portions in said recesses in locking engagement therewith so as to prevent separation of said bulkheads in a longitudinal direction, and said vertically extending edge faces of said lugs and said recesses are positioned in abutting engagement so as to prevent motion between said bulkheads in a side-to-side direction.

2. The segmented boat of claim 1, wherein said engagement means further comprises:

means for preventing upper edges of said bulkheads from spreading apart in said longitudinal direction.

3. The segmented boat of claim 2, wherein said means for preventing said upper edges from spreading apart comprises:

at least one bolt for passing through cooperating bores in said first and second bulkheads proximate said upper edges thereof.

4. The segmented boat of claim 2, wherein said means for preventing said upper edges from spreading apart comprises:

a channel member configured to fit over said upper edges of said bulkheads and having depending flange portions for fitting against other surfaces of said first and second bulkheads.

5. The segmented boat of claim 4, wherein said lugs and said recesses extend continuously to upper edges of said first and second bulkheads, so that upper edges of said faces of said lugs and recesses, and of said flat areas on said bulkheads, form an interlocking zigzag pattern along said upper edges of said bulkheads when joined.

6. The segmented boat of claim 1, wherein said engagement means further comprises:

an inlet bevel formed along a bottom and sides of said first bulkhead; and an outer bevel formed along a bottom and sides of said second bulkhead;

said bevels being configured to react against one another to guide said flange portions on said lugs into said socket portions in said recesses in response to movement of said bulkheads into face-to-face abutment.

7. The segmented boat of claim 6, wherein said first section is a bow section and has said first bulkhead thereon, and said second section is a stern section and has said second bulkhead thereon, so that said bevels on said bottoms and sides of said bulkheads are angled with an intended direction of flow of water over said boat.

8. The segmented boat of claim 7, wherein said bow section is sized to fit within said stern section so as to permit said sections to be nested for storage.

9. The segmented boat of claim 8, wherein said inlet bevel extends outwardly from said first bulkhead substantially as far as said lugs extend outwardly therefrom, so as to protect said lugs from damage as said bow section is nested within said stern section.

10. The segmented boat of claim 7, wherein said bow section is configured to be placed atop said stern section in an inverted position so as to form an enclosed storage container.

11. The segmented boat of claim 10, wherein each said section comprises:

upstanding wall portions which define a gunwale edge;

said gunwale edge of said bow section being matched to said gunwale edge of said stern section in said inverted position so as to form a seal therewith.

12. The segmented boat of claim 11, further comprising:

means for mounting said enclosed storage container which is formed by said bow and stern sections atop a vehicle as a cartop carrier.

13. A segmented boat comprising:

a first section having a first transverse bulkhead at an end thereof;

a second section having a second transverse bulkhead at an end thereof;

at least one lug member formed on and extending from said first bulkhead, said lug member having a flange portion formed on and extending downwardly and outwardly from a lower edge of said lug member, and edge portions which extend substantially perpendicularly to said transverse bulkhead;

at least one recess member formed in and extending into said second bulkhead for receiving said lug member as said bulkheads are moved together into face-to-face abutment along a substantially common plane, said recess member having a socket portion formed in and extending downwardly and inwardly from a lower edge of said recess member so that an upwardly extending lip is formed at an outer edge thereof, and edge portions which extend substantially perpendicularly to said transverse bulkhead, said socket portion being configured to receive said flange portion of said lug member so that said flange portion fits behind said upwardly extending lip and is retained in said socket portion thereby so as to hold said bulkheads together against pulling apart in a direction generally perpendicular to said common plane, and said edge portions of said recess member being configured to abut said edge portions of said lug member so as to resist shearing movement between said bulkheads in a direction generally parallel to said common plane;

an inlet bevel portion formed along a bottom and side edges of said first bulkhead and an outer bevel portion formed along a bottom and side edges of said second bulkhead, said bevel portions being configured to cooperatively react against one another to guide said lug member into engagement with said recess member in response to movement of bulkheads together into face-to-face abutment; and locking means for selectively restraining said first bulkhead against upward movement relative to said second bulkhead, so as to prevent separation of said lug member from said recess member by said flange portion lifting over said lip of said socket portion.

* * * * *